US005653636A

United States Patent [19]

Takemoto et al.

[11] Patent Number: 5,653,636

[45] Date of Patent: Aug. 5, 1997

[54] SLOT MACHINE USING GAME PLAY MEDIA AND METHOD FOR SETTING THE NUMBER OF GAME PLAY MEDIA TO BE WON

[75] Inventors: Takatoshi Takemoto; Kazunari Kawashima, both of Tokyo, Japan

[73] Assignee: Kabushiki Kaisha Ace Denken, Tokyo, Japan

[21] Appl. No.: 513,837

[22] PCT Filed: Jan. 17, 1994

[86] PCT No.: PCT/JP94/00054

§ 371 Date: Aug. 31, 1995

§ 102(e) Date: Aug. 31, 1995

[87] PCT Pub. No.: WO94/20178

PCT Pub. Date: Sep. 15, 1994

[30] Foreign Application Priority Data

Mar. 4, 1993 [JP] Japan ..... 5-043618

[51] Int. Cl.[6] ..... G07F 17/34

[52] U.S. Cl. ..... 463/20; 273/143 R

[58] Field of Search ..... 273/143 R, 138.2; 463/20, 21

[56] References Cited

U.S. PATENT DOCUMENTS 5,516,104 5/1996 Takemoto et al. ..... 463/20

FOREIGN PATENT DOCUMENTS

| | | |
|---|---|---|
| 0 569 234 | 2/1988 | Australia . |
| 0 070 679 | 1/1983 | European Pat. Off. . |
| 0 164 877 | 12/1985 | European Pat. Off. . |
| 57-148975 | 9/1982 | Japan . |
| 3-136681 | 6/1991 | Japan . |

*Primary Examiner*—Benjamin H. Layno
*Attorney, Agent, or Firm*—Seed and Berry LLP

[57] ABSTRACT

At a slot machine for executing a game upon receipt of a predetermined number of game play media, when a game execution start instruction is received, if the fact that the number of received game play media is less than the predetermined number of game play media is detected, the number of game play media won for a predetermined symbol combination is set in response to the number of the received game play media, whereby the slot machine enables a player to play a game without returning an incomplete number of game play media, which is less than a reference number, to the player.

9 Claims, 4 Drawing Sheets

SLOT MACHINE USING GAME PLAY MEDIA AND METHOD FOR SETTING THE NUMBER OF GAME PLAY MEDIA TO BE WON

TECHNICAL FIELD

This invention relates to a gaming machine, such as a slot machine, for determining the reference number of pachinko balls (Japanese pinballs) corresponding to one medal and paying out pachinko balls for a winning game play in accordance with a symbol combination on drums.

TECHNICAL BACKGROUND

For example, a player inputs flat articles such as medals or coins for playing a game with conventional slot machines, which are manually replenished with medals or coins because it is difficult to mechanize the handling of medals or coins. As personnel expenses are soaring nowadays, it is desired to save manpower and to automate the operation. Therefore, pachinko balls whose handling is comparatively easily mechanized are used as game play media instead of medals, coins, etc., and replenishment of the slot machine with pachinko balls and collection of pachinko balls are automated.

Since the conventional slot machines may coexist with pachinko ball machines in a single gaming house, the number of pachinko balls corresponding to one medal with respect to the economic value is five, a predetermined reference number. The reference number is fixedly predetermined for the economic value of one medal. For example, for a player to play a game with five, 10, or 15 pachinko balls, one gaming line is applied with five pachinko balls corresponding to one medal; three gaming lines are applied with 10 pachinko balls corresponding to two medals; five gaming lines are applied with 15 pachinko balls corresponding to three medals. The gaming line means a symbol position combination on drums. Assume that when three symbols are displayed on each of three slots, five gaming lines are applied. With such a slot machine, after inputting pachinko balls to a slot, a player handles a game play lever for rotating the three drums on which symbol patterns are displayed, then presses push button stop switches provided on the main unit of the slot machine in sequence for stopping rotation of the drums. A predetermined number of pachinko balls are paid out to the player from the slot machine in response to symbol display combinations after the drum rotation stops if the player wins the game.

However, at such a conventional slot machine, the player may drop or pick up pachinko balls during game play and four or less pachinko balls may remain as an incomplete number of pachinko balls, in which case no gaming lines can be set and the remaining pachinko balls are returned to the player, who has a problem with the incomplete number of pachinko balls.

DISCLOSURE OF INVENTION

It is therefore an object of the invention to provide a slot machine capable of setting the reference number.

To this end, according to the invention, there is provided a slot machine for executing a game upon receipt of a predetermined number of plurality of game play media, the slot machine comprising:

means for counting the number of the received game play media;

gaming line selection means for defining a plurality of gaming lines, combinations of symbol positions on drums, and selecting at least one among the plurality of gaming lines;

means for defining the predetermined number of game play media for each of the gaming lines;

means for detecting the number of game play media counted by the count means being less than the predetermined number of game play media defined by the definition means for the gaming line selected by the gaming line selection means;

means for setting the number of game play media won for a predetermined symbol combination in response to the number of game play media counted by the count means upon detection by the detection means; and means for informing a player that the player cannot play a game if the number of won game play media set by the number-of-won-game-play-media setting means does not become an integer.

The slot machine can further include means for displaying the number of won game play media set by the number-of-won-game-play-media setting means.

The number-of-won-game-play-media setting means can set the number of won game play media for each of the gaming lines.

The information means may further inform the player of gaming lines that can be selected if the number of won game play media set by the number-of-won-game-play-media setting means does not become an integer.

If such solution means are provided, the following operation is performed:

The count means counts the number of the received game play media; it may count the number of game play media input for playing a slot machine game or if game play media are previously held in the slot machine and the player specifies the number of game play media for playing a game, it may count the game play media when the specified number of game play media is subtracted from the number of held game play media.

The gaming line selection means defines a plurality of gaming lines, combinations of symbol positions on slots, and selects at least one among the plurality of gaming lines. The definition means defines the predetermined number of plurality of game play media for each of the gaming lines.

The detection means detects the number of the game play media counted by the count means being less than the predetermined number of plurality of game play media defined by the definition means for the gaming line selected by the gaming line selection means. When the number of game play media counted by the count means is the predetermined number of game play media, a normal game is played.

The number-of-won-game-play-media setting means sets the number of game play media won for a predetermined symbol combination in response to the number of game play media counted by the count means upon detection by the detection means.

The information means informs a player that the player cannot play a game if the number of won game play media set by the number-of-won-game-play-media setting means does not become an integer.

Thus, even if the player has an incomplete number of game play media less than the predetermined number of plurality of game play media, he or she can play a game. For example, when one gaming line is applied with five pachinko balls, three gaming lines are applied with 10 pachinko balls, and five gaming lines are applied with 15 pachinko balls, as described above, if a player inputs four or less, six to nine, or 11 to 14 pachinko balls, the number of won game play media is set in response to the gaming line selected by the gaming line selection means and the number of game play media. Thus, even if the player inputs game play media in a number other than the reference number, he or she can still play a game. If the number of won game play media set by the number-of-won-game-play-media setting means does not become an integer, the player is informed that he or she cannot play a game, so that the player can recognize the fact.

According to the invention, there is provided another slot machine for executing a game upon receipt of a predetermined number of plurality of game play media, which may comprise:

means for displaying a plurality of symbols for each drum;

display control means for controlling the display means so as to carry out static condition display and dynamic condition display for each drum of the display means;

means for counting the number of the game play media held by the player playing a game;

means for receiving specification of information concerning gaming lines, combinations of symbol positions on drums, and a multiplying factor for the gaming line;

means for setting the gaming lines acknowledged by the reception means;

number-of-won-game-play-media setting means for defining the number of game play media won for a predetermined symbol combination based on a reference number, finding the number of game play media required for playing a game based on the information concerning the gaming lines and multiplying factor received by the reception means, and setting a won game play media number multiplying factor by which the number of won game play media is to be multiplied based on the found number of game play media and the number of held game play media counted by the count means;

means for informing a player that the player cannot play a game if multiplying the number of won game play media by the won game play media number multiplying factor set by the number-of-won-game-play-media setting means does not result in an integer;

means for determining whether or not a symbol combination on the gaming line set by the gaming line setting means after symbol change stops matches the predetermined symbol combination; and means for dispensing game play media for a winning game play based on the number of won game play media and the won game play media number multiplying factor set by the number-of-won-game-play-media setting means when the determination means determines that the symbol combinations match.

According to another aspect of the invention, there is provided a method for setting the number of won game play media at a slot machine for executing a game upon receipt of a predetermined number of plurality of game play media, which can comprise the steps of:

counting the number of received game play media;

defining a plurality of gaming lines, combinations of symbol positions on drums, and selecting at least one among the plurality of gaming lines;

defining the predetermined number of plurality of game play media for each of the gaming lines;

detecting the number of game play media counted being less than the predetermined number of plurality of game play media defined for the gaming line selected;

setting the number of game play media won for a predetermined symbol combination in response to the number of game play media counted by the count means upon the detection; and informing a player that the player cannot play a game if the number of won game play media set does not become an integer.

The function in the slot machine is as follows:

The count means counts the number of game play media held by the player playing a game; the number of actually taken-in game play media may be counted and held or the number of held game play media may be read from a storage medium such as a prepaid card on which it is stored.

The reception means receives specification of information Concerning gaming lines, combinations of symbol positions on slots, and a multiplying factor for the gaming line. The gaming line setting means sets the gaming lines acknowledged by the reception means. The found number of game play media is subtracted from the number of held game play media counted by the count means. The number-of-won-game-play-media setting means defines the number of game play media won for a predetermined symbol combination based on the reference number, finds the number of game play media required for playing a game based on the information concerning the gaming lines and multiplying factor received by the reception means, and sets a won game play media number multiplying factor by which the number of won game play media is to be multiplied based on the subtraction number from the number of held game play media stored in the storage means at the gaming line setting means.

When a start instruction is given for each drum of the display means, the display control means controls the display means so as to carry out gaming condition display from static condition display and when a stop instruction is given for each drum of the display means, it controls the display means so as to carry out static condition display from the gaming condition display. The determination means determines whether or not a symbol combination on the gaming line set by the gaming line setting means after symbol change stops matches the predetermined symbol combination. The means for dispensing game play media for a winning game play dispenses game play media based on the won game play media number multiplying factor set by the number-of-won-game-play-media setting means when the determination means determines that the symbol combinations match. Thus, even if the number of game play media becomes incomplete, a game can be played. If multiplying the number of won game play media by the won game play media number multiplying factor set by the number-of-won-game-play-media setting means does not result in an integer, the information means informs the player that he or she cannot play a game, so that the player can recognize the fact.

BEST MODE FOR CARRYING OUT THE INVENTION

Referring now to the accompanying drawings, there is shown one embodiment of the invention. FIGS. 1 to 4 show the embodiment of the invention.

In the embodiment, to make effective use of already existing facilities for also dealing with a bet number of pachinko balls smaller than a setup reference value, if the number of pachinko balls taken in a slot machine to play a game is the setup reference value, pachinko balls will be paid out for a winning game play according to a setup multiplying factor; if it is less than the setup reference value, the gaming lines and the multiplying factor of the number of pachinko balls paid out for a winning game play, which will be hereinafter referred to as won pachinko ball number multiplying factor, will be set in response to the number of input pachinko balls.

Figure 2:
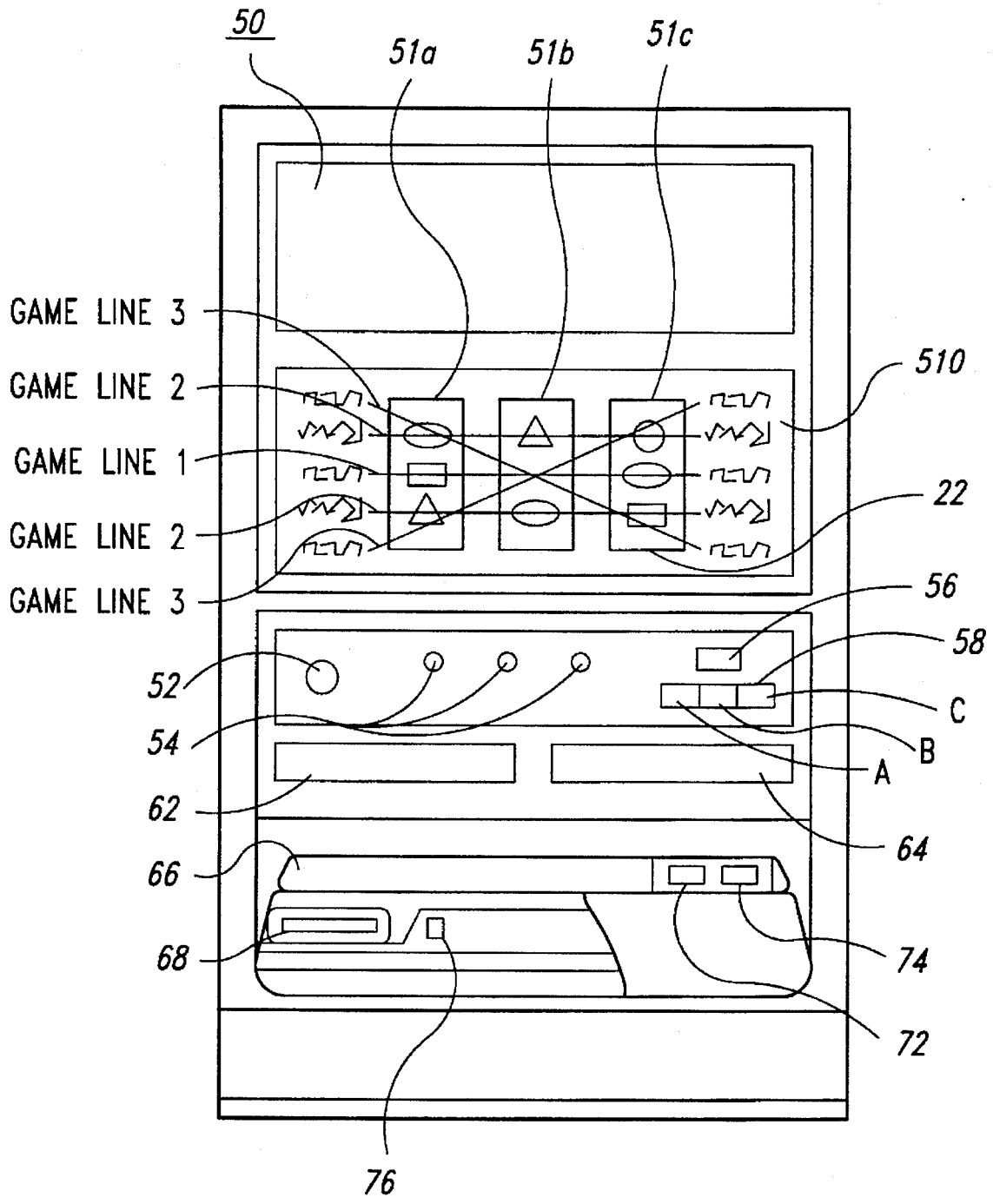
FIG. 2 is a front view of the slot machine showing the embodiment of the invention.
Figure 3:
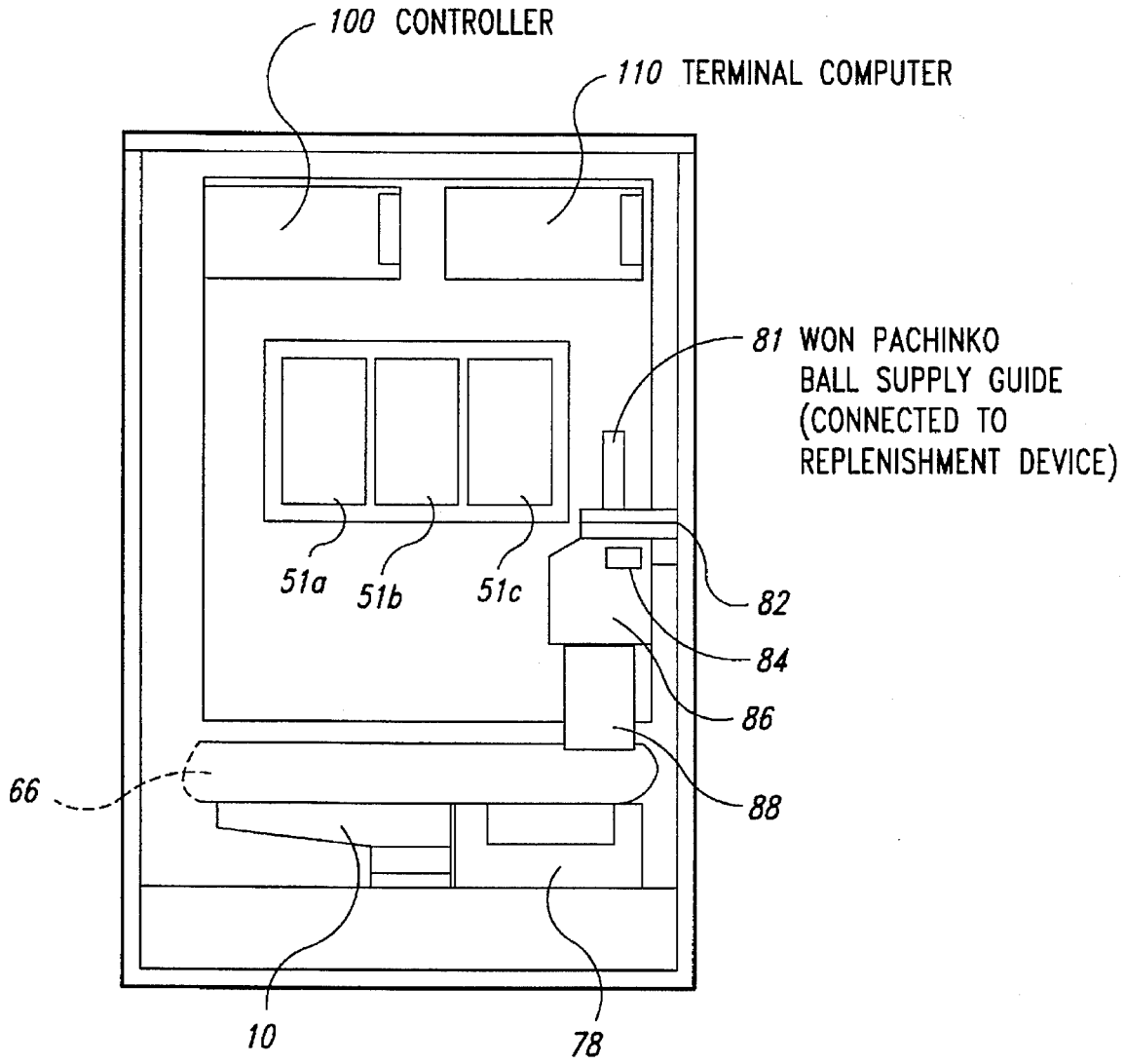
FIG. 3 is a rear view of the slot machine showing the embodiment of the invention.

As shown in FIGS. 2 and 3, a game display section 50 for displaying symbol combinations, etc., as winning game plays is provided in the upper front portion of a slot machine main unit 10, and a symbol display section 510 for displaying slot machine symbols is located below the game display section 50. The symbol display section 510 is provided with three symbol display means 51*a*, 51*b*, and 51*c*. It has three display windows 22 formed on the front of the main unit 10, three drums located inside the main unit 10 corresponding to the three display windows, and drive means that can rotate the drums separately (not shown). A large number of symbols including digits and characters are drawn on the outer peripheral surfaces of the drums, which are placed in the windows so that three symbols on each drum are always seen through the corresponding display window. Each symbol display means 51 rotates if a game start instruction is given, and stops if a game stop instruction is given; in the stop state, three symbols are displayed on the display surface from top to bottom. The symbol display section 510 may use a display unit such as a liquid crystal display in place of the drums for displaying symbols.

As gaming lines, the center line connecting the symbols only at the vertical center positions is line 1; the upper line connecting the symbols at the top positions and the lower line connecting the symbols at the bottom positions are game lines 2; and the oblique line connecting the symbols at the top position of the left drum, the center position of the center drum, and the bottom position of the right drum and the oblique line connecting the symbols at the bottom position of the left drum, the center position of the center drum, and the top position of the right drum are gaming lines 3. When the gaming lines are selected by handling a game bet number selection switch 58, the selected lines go on.

Provided below the symbol display section 510 are a game start lever 52 for accepting a game start instruction, symbol display means stop switches 54 being located corresponding to the symbol display means for accepting a stop instruction of the corresponding symbol display means, a game bet number display 56 for displaying the game bet number of pachinko balls, and game bet number selection switch 58 for selecting the game bet number of pachinko balls, below which a number-of-held-pachinko balls display 62 for displaying the number of held pachinko balls that can be adjusted and a number-of-credit-pachinko balls display 64 are disposed. The number of credit pachinko balls refers to the number of pachinko balls paid out for winning game plays, but not yet dispensed. Provided below the displays 62 and 64 are a pachinko ball return 66 for holding pachinko balls, a card slot 68 through which a card described below is inserted and output, a pachinko ball taking-in switch 72 for taking pachinko balls in the slot machine to hold the pachinko balls contained in the pachinko ball return 66 in the slot machine, and a dispensing switch 74 for instructing the slot machine to dispense the pachinko balls held in the gaming machine as held pachinko balls to the pachinko ball return 66. The player handles the pachinko ball taking-in switch 72 for taking the pachinko balls contained in the pachinko ball return 66 in the slot machine. The number of taken-in pachinko balls is displayed on the number-of-held-pachinko balls display 62.

To play a game, a player handles the game bet number selection switch 58 to select gaming lines. The number of pachinko balls corresponding to the selected gaming lines is subtracted from the number of pachinko balls displayed on the number-of-held-pachinko balls display 62 or the number-of-credit-pachinko balls display 64. For the gaming lines, the player handles the game bet number selection switch 58 for selectively switching among application of only gaming line 1, which will be hereinafter referred to as selection I, application of gaming lines 1 and 2, which will be hereinafter referred to as selection II, and application of gaming lines 1, 2, and 3, which will be hereinafter referred to as selection III. Further, assume that the game bet number selection switch 58 can be used to set the multiplying factor for the gaming lines. The specified number of won pachinko balls can be multiplied by the multiplying factor. The game bet number selection switch 58 consists of, for example, three buttons of button A for selectively switching among selections I to III of the gaming lines, button B for increasing the multiplying factor each time the button is pressed, and button C for clearing the values set by the buttons A and B when the button C is pressed. In this case, a number of pachinko balls required for playing a game are taken in the slot machine in response to the gaming lines and the multiplying factor set by handling the game bet number selection switch 58. For example, when a multiplying factor of one is set, if selection I is selected for the gaming lines, five pachinko balls (reference number) are taken in the slot machine and only game line I is set; if selection II is selected for the gaming lines, ten pachinko balls (reference number× 2) are taken in the slot machine and game lines 1 and 2 (three lines in total) are set; if selection III is selected for the gaming lines, 15 pachinko balls (reference number×3) are taken in the slot machine and game lines 1, 2 and 3 (five lines in total) are set. When selection I is selected for the gaming lines, if the number of pachinko balls taken in the slot machine is less than the number of pachinko balls required for playing a game (when the number of held and credit pachinko balls does not reach the reference number), only game line 1 is set and the won pachinko ball number multiplying factor is changed. When a multiplying factor of one is set and selection II is selected for the gaming lines, game lines 1 and 2 (three lines in total) are set; when the multiplying factor of one is set and selection III is selected for the gaming lines, game lines 1, 2 and 3 (five lines in total) are still set. When the gaming lines are set, if the number of pachinko balls taken in the slot machine does not reach the number of pachinko balls required for each game, the won pachinko ball number multiplying factor is changed although the gaming lines are set. The won pachinko ball number multiplying factor is changed in a won pachinko ball number multiplying factor setting section described below. The button B is used to select a multiplying factor for the gaming lines. For example, a multiplying factor of one is set as the initial value and each time the button is pressed, the multiplying factor is changed to two, three . . . etc. The maximum multiplying factor is preset for the button B and a ring counter is set so that the multiplying factor returns to one after the maximum multiplying factor is selected. For example, when selection II is selected for the gaming lines, if the multiplying factor is set to three, 30 pachinko balls are taken in the slot machine from reference number 10×3. As described above, when the number of held pachinko balls is less than 30, for example, if 28 pachinko balls are taken in to the slot machine, won pachinko ball number multiplying factor n (where n is a real number), 2.8, is set and the won pachinko ball number multiplying factor 2.8 is displayed on the game bet number display 56. However, if selection III is selected for the gaming lines and a multiplying factor is selected, when only one pachinko ball is taken in the slot machine, the won pachinko ball number multiplying factor becomes 1/15. If the symbol combination is a predetermined won pachinko ball combination and the minimum number of won pachinko balls is five (reference number), the number of won pachinko balls does not become an integer, thus the player cannot play a game. In this case, the slot machine can inform the player that he or she is requested to change selection of the gaming lines or the multiplying factor. If multiplying the minimum number of won pachinko balls by the won pachinko ball number multiplying factor does not result in an integer, the player may be informed of gaming lines and multiplying factors that can be selected. A message requesting the player to change selection of the gaming lines or the multiplying factor may also be displayed on the game display section 50 or output in the form of a voice.

As shown in FIG. 3, the slot machine contains a taken-in pachinko ball counter 10 for counting the number of taken-in pachinko balls below the pachinko ball return 66. After the number of taken-in pachinko balls is counted by the taken-in pachinko ball counter 10, it is displayed on the number-of-held-pachinko balls display 62. The pachinko ball machine also contains a card information reader/writer 78 on the rear of the card slot 68. The card may be a card having a data recording function, such as a prepaid card, or a credit identification medium on which data certifying that credit is given is recorded, such as a credit card. In addition, the slot machine contains a mechanism for dispensing won pachinko balls to the pachinko ball return 66, and a won pachinko ball supply guide 81, a passage for supplying won pachinko balls from a replenishment device, is connected to the mechanism. This mechanism consists of a shutter 82 for allowing pachinko balls supplied from the won pachinko ball supply guide 81 to pass through or disabling them from passing through, a shutter lever 84 for opening and closing the shutter 82, an endless counter 86 for counting down the setup number of pachinko balls, and a won pachinko ball dispensing duct 88 through which a setup number of pachinko balls can be dispensed.

Further, a controller 100 for performing game control of the slot machine and a terminal computer 110 being connected to the controller 100 for performing processing related to game control of the slot machine are disposed. The controller 100 and the terminal computer 110 serve as a control system which controls the slot machine.

Figure 1:
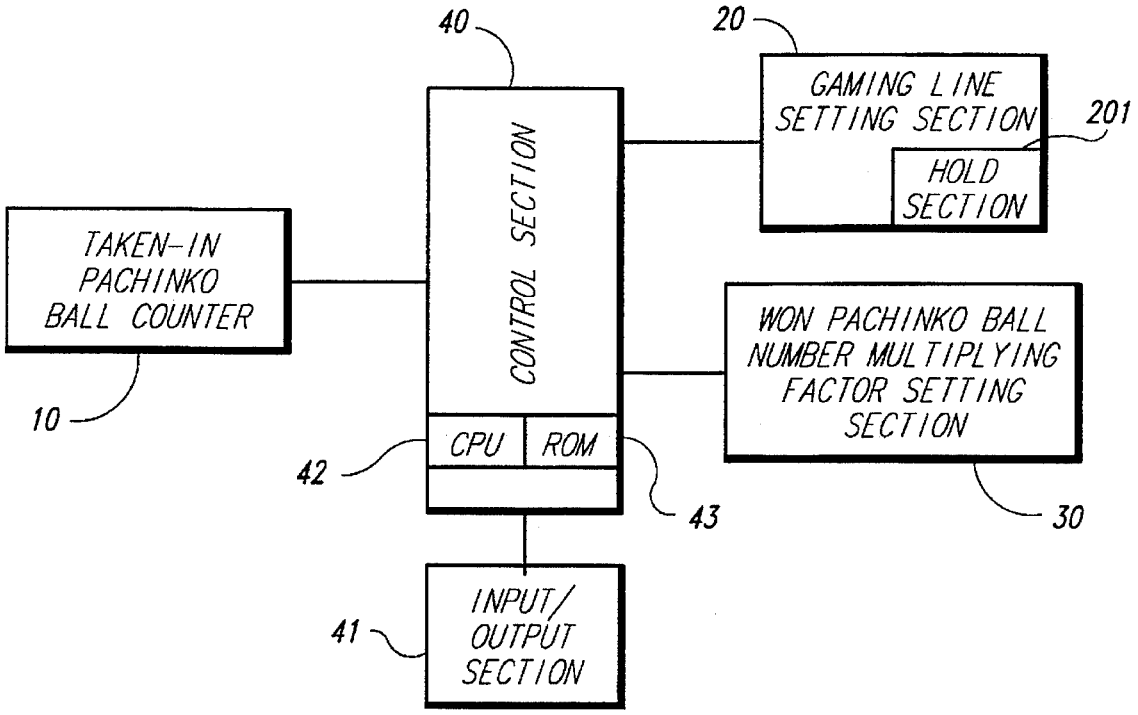
FIG. 1 is a conceptual drawing of a slot machine showing one embodiment of the invention.

As shown in FIG. 1, the control system has a gaming line setting section 20 for setting gaming lines, a won pachinko ball number multiplying factor setting section 30 for setting a won pachinko ball number multiplying factor, a control section 40 for controlling game execution, and an input/output section 41 for inputting and outputting data to and from the control system.

The gaming line setting section 20 sets the gaming lines as described above as a player operates the game bet number selection switch for selecting the gaming lines. Thus, it has a hold section 201 for holding the predetermined number of game play media for each gaming line. The hold section 201 holds the reference numbers of game play media corresponding to the gaming lines, such as five pachinko balls when selection I is selected for the gaming lines, ten pachinko balls when selection II is selected for the gaming lines, and 15 pachinko balls when selection III is selected for the gaming lines, as described above.

The won pachinko ball number multiplying factor setting section 30 sets a won pachinko ball number multiplying factor (allotment rate) when symbols, etc., are combined on the setup gaming lines; it determines the number of won pachinko balls for a predetermined symbol combination based on the reference number and sets the won pachinko ball number multiplying factor by which the number of won pachinko balls is to be multiplied, based on the number of held pachinko balls. At that time, if a player operates the game bet number selection switch 58, the number of pachinko balls required for playing a game is found based on the gaming lines and multiplying factor accepted when the game bet number selection switch 58 is operated, as many pachinko balls as the found number are taken into the slot machine from the pachinko ball return 66, and the selected multiplying factor is displayed on the game bet number display 56. Alternatively, when a player operates the pachinko ball taking-in switch 72 for taking the pachinko balls on the pachinko ball return 66 into the slot machine, the number of pachinko balls are counted by the counter in the slot machine and the held pachinko ball count is displayed on the number-of-held-pachinko balls display 62, whereby when the player operates the game bet number selection switch 58, the number displayed on the number-of-held-pachinko balls display 62 is decremented and the result is displayed and the selected multiplying factor is displayed on the game bet number display 56. Alternatively, if pachinko balls are paid out for a winning game play and the number-of-credit-pachinko balls display 64 is counted up, when the player operates the game bet number selection switch 58, the number displayed on the number-of-credit-pachinko balls display 64 is decremented and the result is displayed and the selected number of pachinko balls is displayed on the game bet number display 56;

If the number of taken-in pachinko balls is less than the number of pachinko balls required for playing a game, the won pachinko ball number multiplying factor setting section 30 is adapted to reduce the won pachinko ball number multiplying factor compared with the number of pachinko balls required for playing a game. In this case, the won pachinko ball number multiplying factor is a factor by which the number of won pachinko balls predetermined for each symbol combination for a winning game play is multiplied. The number of won pachinko balls for each symbol combination is predetermined in the won pachinko ball number multiplying factor setting section 30. For example, if the symbol combination is "7, 7, 7," 30 medals are paid out for the winning game play at a multiplying factor of one corresponding to one medal. In this case, when the multiplying factor for one line is four (four medals), 4×30=120 medals are paid out for the winning game play. That is, if one medal has an economic value of five pachinko balls, 600 pachinko balls are paid out. If the number of taken-in pachinko balls is less than the number of pachinko balls required for playing a game, pachinko balls are paid out for a winning game play according to a multiplying factor of pachinko balls. For example, when the bet number of pachinko balls for one line is two, 2×30=60 pachinko balls are paid out for the winning game play. At that time, assume that when two or more lines are selected as the gaming lines, the same won pachinko ball number multiplying factor is set for all the lines.

If the number of taken-in pachinko balls equals the number of pachinko balls required for playing a game, the control section 40 pays out pachinko balls for a winning game play according to the setup multiplying factor. If the number of taken-in pachinko balls is less than the number of pachinko balls required for playing a game, the control section 40 also controls the gaming line setting section 20 and the won pachinko ball number multiplying factor setting section 30 for setting the gaming lines and won pachinko ball number multiplying factor in response to the number of input pachinko balls. As shown in FIG. 1, the control section comprises a central processing unit (CPU) 42 for performing processing and a ROM (read-only memory) 43 for previously storing processing procedures such as programs. The ROM 43 stores processing procedures in the gaming line setting section 20, the won pachinko ball number multiplying factor setting section 30, and the control section 40.

In the embodiment, the reference number is set to five pachinko balls, but the number of pachinko balls may be other than five for the reference number. The reference number is set in the control section 40 through the input/output section 41 of a keyboard, reference number change switch, etc., shown in FIG. 1. Further, the won pachinko bar number multiplying factor, etc., set by the won pachinko ball number multiplying factor setting section 30 can be output from the input/output section 41.

Figure 4:
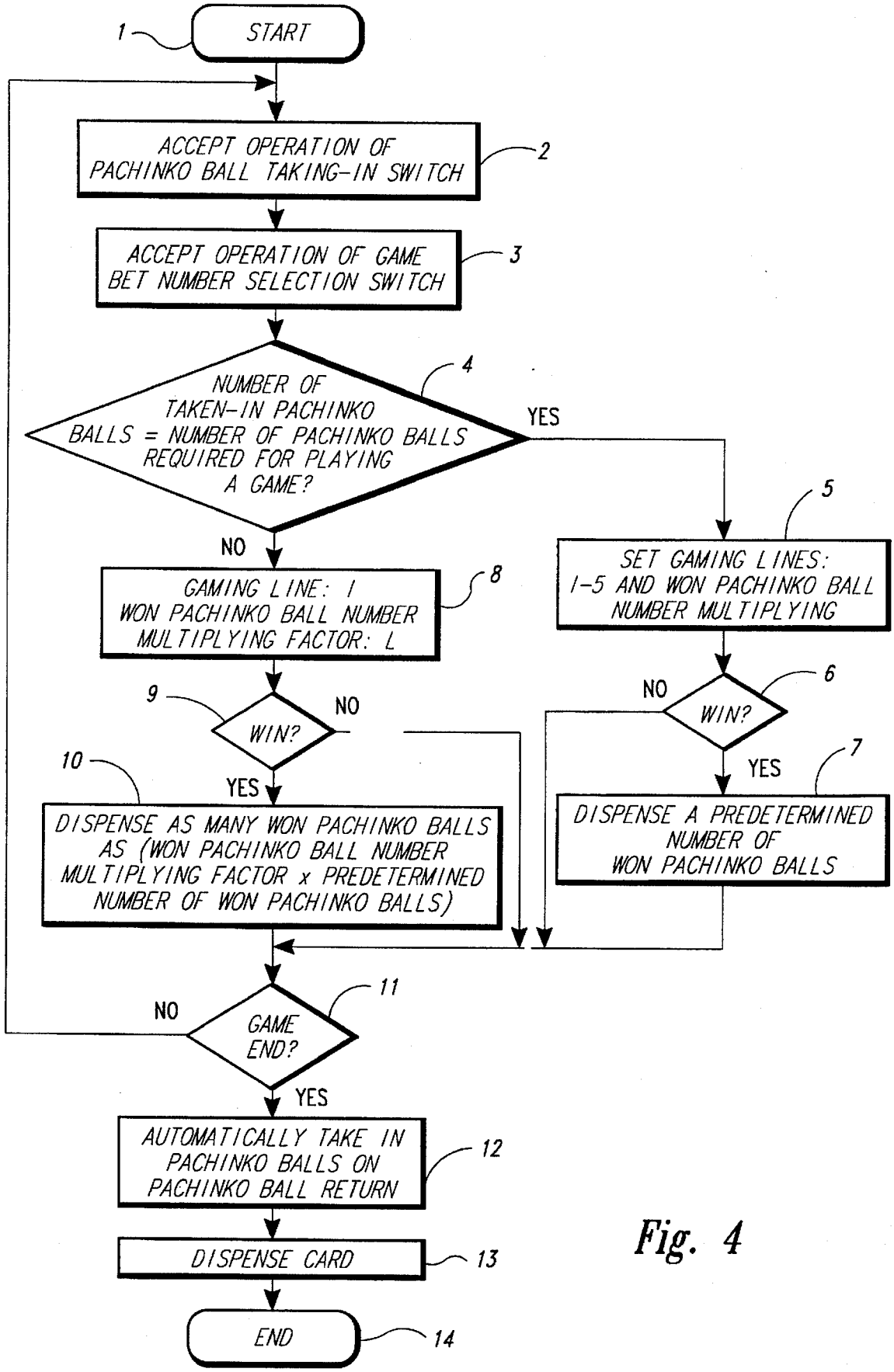
FIG. 4 is a flowchart of the slot machine showing the embodiment of the invention.

Next, the operation will be discussed with reference to a flowchart shown in FIG. 4.

In the embodiment, the reference number of pachinko balls corresponding to one medal is five.

To start playing a game, a player enters pachinko balls in the pachinko ball return. To do this, the player shifts pachinko balls borrowed from a pachinko ball lending machine attached to the side of a gaming machine to the pachinko ball return or inputs cash to a pachinko ball lending machine for dispensing pachinko balls to the pachinko ball return through the endless counter 86 of the gaming machine. If the player inserts a prepaid card, the information stored on the prepaid card is read and the number of held pachinko balls is displayed on the number-of-held-pachinko balls display 62, enabling the player to start playing a game (step 1).

At step 2, when the player operates the taking-in switch 72, pachinko balls on the pachinko ball return are taken in the gaming machine, the number of taken-in pachinko balls is counted by the taken-in pachinko ball counter 10, and the held pachinko ball count is displayed on the number-of-held-pachinko balls display 62.

At step 3, the player handles the game bet number selection switch 58 for selecting the gaming lines and multiplying factor in one game. The gaming line setting section 20 sets and turns on the gaming lines as described above in response to the gaming lines and multiplying factor selected by handling the game bet number selection switch 58. The won pachinko ball number multiplying factor setting section 30 sets a won pachinko ball number multiplying factor applied when symbols, etc., are combined on the setup gaming line, as described above. The won pachinko ball number multiplying factor is displayed on the game bet number display 56 and the number of pachinko balls corresponding to the multiplying factor is subtracted from the number-of-held-pachinko balls display 62 and the remainder is displayed. The number of pachinko balls required for playing a game is calculated from the selected gaming lines and multiplying factor for use as a reference value and the won pachinko ball number multiplying factor can be found from the ratio of the number of actually taken-in pachinko balls at that time, to the reference value. As described above, if multiplying the minimum number of won pachinko balls by the won pachinko ball number multiplying factor does not result in an integer, the player is informed of the gaming lines and multiplying factor that can be selected.

At step 4, whether or not the number of taken-in pachinko balls equals the reference value is determined. If they equal each other, control goes to step 5; if they do not equal each other, control goes to step 8.

At step 5, when the player operates the game start lever 52, the control section 40 controls the symbol display section 510 for displaying symbols in rotation using the symbol display means 51. When the game start lever 52 is operated, the gaming line setting section 20 and the won pachinko ball number multiplying factor setting section 30 determine the gaming lines and won pachinko ball number multiplying factor set at that time.

At step 6, when the player operates the symbol display means stop switches 54, the symbols on the symbol display means 51 stop. If the symbol combination on the setup gaming line is a wining combination, as many pachinko balls as (won pachinko ball number multiplying factor× predetermined number of won pachinko balls) are paid out to the player for the winning game play. The pachinko balls are passed through the endless counter 86 and the won pachinko ball dispensing duct 88 and are dispensed from the replenishment device (not shown) via the won pachinko ball supply guide 88 to the pachinko ball return 66. Alternatively, the number of pachinko balls paid out for the winning game play is set on the number-of-credit-pachinko balls display 64. When a predetermined number of won pachinko balls are dispensed, control returns to step 2 for the player to play another game.

If the number of taken-in pachinko balls is not the same as the reference value at step 4, the control section 40 controls the gaming line setting section 20 and the won pachinko ball number multiplying factor setting section 30 for determining the won pachinko ball number multiplying factor responsive to the gaming lines and multiplying factor at step 8.

If the symbol combination on game line 1 is a winning combination at step 9, a predetermined number of pachinko balls (won pachinko ball number multiplying factor× predetermined number of won pachinko balls) are passed through the endless counter 86 and the won pachinko ball dispensing duct 88 and are dispensed from the replenishment device (not shown) via the won pachinko ball supply guide to the pachinko ball return 66. When a predetermined number of won pachinko balls are dispensed, control returns to step 2 for the player to play another game.

Whether or not the game is ended is determined depending on whether or not the player operates the adjustment switch 76. If the adjustment switch 76 is operated, all pachinko balls on the pachinko ball return 66 are taken into the slot machine, the total number of pachinko balls is displayed on the number-of-held-pachinko balls display 62, and the number displayed on the number-of-credit-pachinko balls display 64 is added to the number-of-held-pachinko balls display 62, followed by display of the result. At this stage, the information is written onto a card by the card information reader/writer 78 and the card is dispensed through the card slot 68. The player can again insert the card into the card slot of a gaming machine for playing another game. At step 11, if a card is inserted, the card contents may be read by the card information reader/writer 78 and the number of pachinko balls recorded on the card may be displayed on the number-of-held-pachinko balls display 62 (or displayed directly on the number-of-credit-pachinko balls display 64). Then, when the player operates the taking-in switch 72, pachinko balls for one game can be taken in the gaming machine for the player to play another game.

Further, the gaming lines may be selected for each line rather than selections I–III as described above.

At step 3, when two or more lines are selected as the gaming lines, the same won pachinko ball number multiplying factor is set for all the lines. Instead, a different multiplying factor may be set for each gaming line. For example, when selection II is selected for the gaming lines, if the multiplying factor is set to two, 20 pachinko balls are taken into the gaming machine from reference number 10×2. When the player holds only 15 pachinko balls rather than 20 pachinko balls, the won pachinko ball number multiplying factor may be set to two for game line 1 and one for game line 2. At that time, the game bet number display 56 can be provided for each game line for displaying the won pachinko ball number multiplying factor for each game line. In this case, if a won pachinko ball number multiplying factor is set so that the reference value is set preferentially for game line 1, and a won pachinko ball number multiplying factor is set for game line 2 according to the remaining number of pachinko balls to meet the reference value, a won pachinko ball number multiplying factor is set for game line 3 according to the remaining number of pachinko balls. If the player cannot play a game, the gaming machine can inform the player that he or she is requested to change selection of the gaming lines or the multiplying factor, as described above.

In the embodiment, the player selects the gaming lines and multiplying factor by operating the game bet number selection switch 58, but may select the number of taken-in pachinko balls rather than the multiplying factor. In this case, the button B, one of the three buttons of the game bet number selection switch 58, which increases the multiplying factor each time the button is pressed, is assigned with the function of increasing the number of taken-in pachinko balls each time the button is pressed. That is, the button B of the game bet number selection switch 58 can be used to set a multiplying factor according to the number of pachinko balls. In this case, for example, when selection I is selected for the gaming lines, if the player selects m (where m is an integer) as the number of taken-in pachinko balls, only game line 1 is set and the won pachinko ball number multiplying factor becomes m/5 (where 5 is the reference number). When selection II is selected for the gaming lines, if the player selects m as the number of taken-in pachinko balls, game lines 1 and 2 (three lines in total) are set and the won pachinko ball number multiplying factor becomes m/10. Likewise, when selection III is selected for the gaming lines, if the player selects m as the number of taken-in pachinko balls, game lines 1, 2, and 3 (five lines in total) are set and the won pachinko ball number multiplying factor becomes m/15.

Thus, the already existing facilities can be and a bet number and a bet number of pachinko balls which is less than the reference value can also be dealt with.

According to the slot machine of the invention, if a player inputs less pachinko balls than the reference number, the control section controls the gaming line setting section and the won pachinko ball number multiplying factor setting section for setting the gaming lines and won pachinko ball number multiplying factor responsive to the number of input pachinko balls, so that the player can play a game and is not inconvenienced by having an incomplete number of pachinko balls, which is less than the reference number, otherwise returned from the slot machine.

We claim:

1. A slot machine for executing a game upon receipt of a predetermined number of game play media, said slot machine comprising:

means for counting the number of the received game play media;

gaming line selection means for defining a plurality of gaming lines, combinations of symbol positions on drums, and selecting at least one among said plurality of gaming lines;

means for defining the predetermined number of plurality of game play media for each of said gaming lines;

means for detecting the number of the game play media counted by said count means being less than the predetermined number of plurality of game play media defined by said definition means for the gaming line selected by said gaming line selection means;

means for setting the number of game play media won for a predetermined symbol combination in response to the number of the game play media counted by said count means upon detection by said detection means; and means for informing a player that the player cannot play a game if the number of won game play media set by said number-of-won-game-play-media setting means does not become an integer.

2. The slot machine as claimed in claim 1 further including means for displaying the number of won game play media set by said number-of-won-game-play-media setting means.

3. The slot machine as claimed in claim 1 wherein said number-of-won-game-play-media setting means sets the number of won game play media for each of said gaming lines.

4. The slot machine as claimed in claim 1 wherein said information means further informs the player of gaming lines that can be selected if the number of won game play media set by said number-of-won-game-play-media setting means does not become an integer.

5. A slot machine for executing a game upon receipt of a predetermined number of game play media, said slot machine comprising:

means for displaying a plurality of symbols for each drum;

display control means for controlling said display means so as to make static condition display and dynamic condition display for each drum of said display means;

means for counting the number of the game play media held by the player playing a game;

means for receiving specification of information concerning gaming lines, combinations of symbol positions on drums, and a multiplying factor for the gaming line;

means for setting the gaming lines acknowledged by said reception means;

number-of-won-game-play-media setting means for defining the number of game play media won for a predetermined symbol combination based on a reference number, finding the number of game play media required for playing a game based on the information concerning the gaming lines and multiplying factor received by said reception means, and setting a won game play media number multiplying factor by which the number of won game play media is to be multiplied based on the found number of game play media and the number of held game play media counted by said count means;

means for informing a player that the player cannot play a game if multiplying the number of won game play media by the won game play media number multiplying factor set by said number-of-won-game-play-media setting means does not result in an integer;

means for determining whether or not a symbol combination on the gaming line set by said gaming line setting means after symbol change stops matches the predetermined symbol combination; and means for dispensing game play media for a winning game play based on the number of won game play media and the won game play media number multiplying factor set by said number-of-won-game-play-media setting means when said determination means determines that the symbol combinations match.

6. The slot machine as claimed in claim 5 further including means for displaying the won game play media number multiplying factor set by said number-of-won-game-play-media setting means.

7. The slot machine as claimed in claim 5 wherein said information means further informs the player of gaming lines that can be selected if the number of won game play media set by said number-of-won-game-play-media setting means does not become an integer.

8. A method for setting the number of won game play media at a slot machine for executing a game upon receipt of a predetermined number of game play media, said method comprising the steps of:

counting the number of received game play media;

defining a plurality of gaming lines, combinations of symbol positions on slots, and selecting at least one among said plurality of gaming lines;

defining the predetermined number of plurality of game play media for each of said gaming lines;

detecting the number of the game play media counted being less than the predetermined number of plurality of game play media defined for the gaming line selected;

setting the number of game play media won for a predetermined symbol combination in response to the number of the game play media counted by said count means upon the detection; and informing a player that the player cannot play a game if the number of won game play media set does not become an integer.

9. The method as claimed in claim 8 further comprising the step of informing the player of gaming lines that can be selected if the number of won game play media set by said number-of-won-game-play-media setting means does not become an integer.

* * * * *